US007900571B2

(12) United States Patent
Jaber et al.

(10) Patent No.: US 7,900,571 B2
(45) Date of Patent: Mar. 8, 2011

(54) BUOY

(75) Inventors: Barry N. Jaber, London (GB); Alan Wignall, Buckinghamshire (GB); John D. Martin, Buckinghamshire (GB)

(73) Assignee: Ultra Electronics Limited, Greenford (GB)

( * ) Notice: Subject to any disclaimer, the term of this patent is extended or adjusted under 35 U.S.C. 154(b) by 0 days.

(21) Appl. No.: 12/090,837

(22) PCT Filed: Oct. 18, 2006

(86) PCT No.: PCT/GB2006/003868

§ 371 (c)(1),
(2), (4) Date: Sep. 15, 2008

(87) PCT Pub. No.: WO2007/045864

PCT Pub. Date: Apr. 26, 2007

(65) Prior Publication Data

US 2009/0149092 A1 Jun. 11, 2009

(30) Foreign Application Priority Data

Oct. 18, 2005 (GB) ..... 0521156.0

(51) Int. Cl.
*B63G 8/14* (2006.01)

(52) U.S. Cl. ..... 114/245; 441/23

(58) Field of Classification Search ..... 114/242, 114/244, 245, 253, 330, 337; 367/17; 441/17, 441/22, 23

See application file for complete search history.

(56) References Cited

U.S. PATENT DOCUMENTS 3,327,968 A * 6/1967 Converse ..... 114/244

(Continued)

FOREIGN PATENT DOCUMENTS

GB 1019645 2/1966

(Continued)

OTHER PUBLICATIONS

International Search Report for International Application No. PCT/GB2006/003868 dated Jan. 19, 2007.

(Continued)

*Primary Examiner* — Lars A Olson

(74) *Attorney, Agent, or Firm* — Marshall, Gerstein & Borun LLP

(57) ABSTRACT

A buoy is provided with first and second fixed hydrodynamic surfaces (15,16). When the buoy is towed through water by a tether (17), the first hydrodynamic surface (15) generates a downward force that reduces with increased speed through the water. The second hydrodynamic surface (16) generates an upward force that increases with increased speed through the water so that the buoy dives up to an upper critical speed through the water speed and rises beyond said upper critical speed through the water. The downward force of the first hydrodynamic surface (15) overcomes the buoyancy of the buoy at a lower critical speed through the water above, which the buoy dives. The hydrodynamic surface (15) comprises first fins (15) mounted on an outer casing (1) of the buoy and are spaced angularity and extend parallel to the center axis of the buoy which is substantially aligned with the direction of towing. The second hydrodynamic surface (16) comprises second fins (16) mounted on the outer casing arranged upstream of the first fins (15) in the direction of towing. The second hydrodynamic surface (16) is set at an angle of incidence such that it creates a stalled flow condition at said upper critical speed through the water.

20 Claims, 4 Drawing Sheets

U.S. PATENT DOCUMENTS

| | | | | | |
|---|---|---|---|---|---|
| 3,453,980 | A | * | 7/1969 | Shock | 114/245 |
| 3,774,570 | A | * | 11/1973 | Pearson | 114/245 |
| 3,921,562 | A | | 11/1975 | Kelly | |
| 3,953,905 | A | | 5/1976 | Paitson | |
| 4,027,616 | A | * | 6/1977 | Guenther et al. | 114/244 |
| 4,463,701 | A | * | 8/1984 | Pickett et al. | 114/245 |
| 4,549,499 | A | | 10/1985 | Huffhines et al. | |
| 4,777,819 | A | | 10/1988 | Hoyt et al. | |
| 5,460,556 | A | | 10/1995 | Logan et al. | |
| 5,642,330 | A | | 6/1997 | Santopietro | |
| 6,883,452 | B1 | | 4/2005 | Gieseke | |

FOREIGN PATENT DOCUMENTS

| | | |
|---|---|---|
| GB | 1 269 599 | 4/1972 |
| WO | WO 96/02856 | 2/1996 |

OTHER PUBLICATIONS

Patents Act 1977: Search Report under Section 17 for GB Applcation No. GB0521156.0, dated Nov. 24, 2005.

Patents Act 1977 Examination Report under Section 18(3) for GB Application No. GB0521156.0 , dated Apr. 16, 2010.

* cited by examiner

BUOY

TECHNICAL FIELD

This invention relates to a buoy adapted to be deployed so that it floats at the water surface and adapted to be recovered by an underwater vessel.

The natural buoyancy of a buoy will generate an upward force that will tend to return it to the surface once submerged. The tension in a tether used to recover a buoy will create a downward force but may not be enough to submerge the buoy completely or to maintain it at an adequate depth.

DISCLOSURE OF THE INVENTION

According to the present invention, a buoy is provided with first and second fixed hydrodynamic surfaces, which when the buoy is towed through water by a tether, the first hydrodynamic surface generates a downward force that reduces with increased through water speed, and the second hydrodynamic surface generates an upward force that increases with increased through water speed, so that the buoy dives at speeds up to an upper critical through water speed and rises at speeds beyond said upper critical through water speed. The buoy can therefore be made to sink or rise in accordance with the towed speed, and its depth thereby controlled. The towed speed will be a combination of the speed of the underwater vessel and the speed of a winch on the vessel winding in the tether to recover the buoy, and therefore, both need to be monitored to control buoy depth during recovery. Assuming a constant vessel speed, the winch speed is the sole control parameter, which needs to be varied to produce any required buoy recovery path through the water. For example, the buoy might be made to dive rapidly by an initial high winch speed, and then be maintained within a predetermined range of depths by varying the winch speed around the upper critical through water speed at which the vertical forces are balanced.

The buoyancy of the buoy will cause it to float at the surface and will cause it to rise in the water when towed until the upward force is overcome by the downward force of the first hydrodynamic surface, at a lower critical through water speed, above which the buoy dives. Thus, the depth of the buoy can be controlled by control of the through water speed about either of the lower or upper critical through water speeds.

The hydrodynamic surfaces preferably comprise a fin or fins mounted on the outer casing of the buoy. The angle of the fins relative to the tow direction will determine the hydrodynamic characteristics of the buoy when towed. The tow connection is preferably located at the lower end of the buoy. The buoy preferably has a smoothly rounded profile to reduce drag forces when being towed, and in one example, this involves the use of a fairing to enclose other structures of the buoy which would cause drag. The profile of the buoy may be such to act as a hydrodynamic surface which generates a downward force that reduces with through water speed.

The first hydrodynamic surface may comprise a fin or fins which are set at an angle of inclination on the casing of the buoy to generate said downward force and to reduce the angle of inclination as the buoy aligns with the tow direction with increasing through water speed. The second hydrodynamic surface may comprise a fin or fins set at an angle of inclination on the casing of the buoy to generate said upward force and to increase the angle of inclination as the buoy aligns with the tow direction with increasing through water speed. Preferably, the first and second hydrodynamic surfaces are formed as rear and front fins, respectively, in the towing directions, and vortex flows generated by the front fins may enhance the downward force of the rear fins.

The second hydrodynamic surface which generates said upward force is preferably set at a high angle of incidence such that it creates a stalled flow condition at said upper critical through water speed. Below this upper critical through water speed, the second hydrodynamic surface is still capable of generating an upward force at a lower angle of incidence when an attached flow condition prevails.

The casing of the buoy preferably comprises a cylindrical body containing electrical equipment, and a hemispherical top which closes the upper end of the cylinder and serves as a radome, and a hemispherical bottom which closes the lower end of the cylinder and supports a downwardly extending elongate member carrying a mass at its lower end. The lower mass serves to lower the centre of gravity of the buoy so that it is below the centre of buoyancy. The buoy then floats upright and has good roll stability. If a fairing is provided around the downwardly extending member and mass, it will also enclose a mass of water, which will also increase surface stability. In a preferred embodiment, the lower mass takes the form of an induction core through which a battery in the buoy can be charged by inductive coupling with an external power source through a docking system with which the lower end of the buoy docks once recovered.

DESCRIPTION OF THE DRAWINGS

The invention will now be described by way of example with reference to the accompanying drawings.

MODE OF CARRYING OUT THE INVENTION

Figure 2:
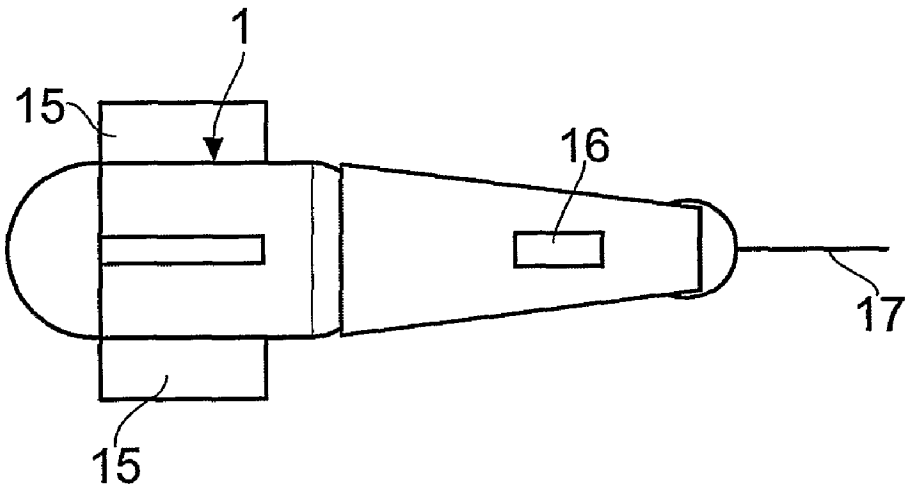
FIG. 2 shows an external side elevation of the buoy of FIG. 1 being towed below the sea surface.
Figure 1:
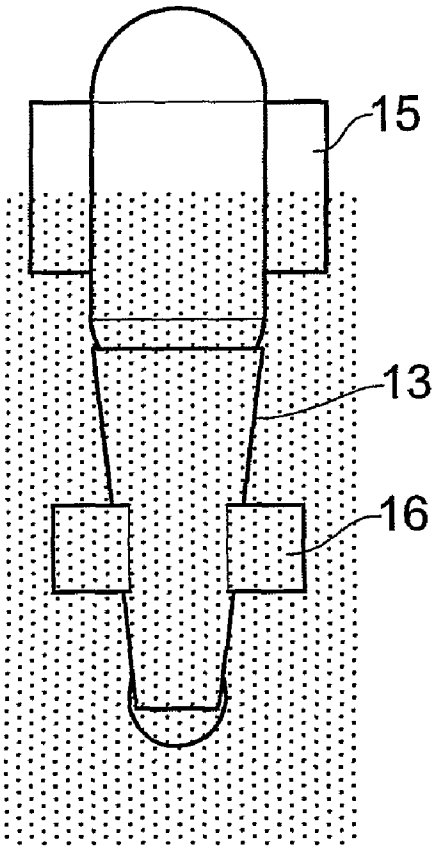
FIG. 1 shows an external side elevation of a buoy according to the invention floating on the surface of the sea.

The buoy illustrated in FIG. 1 comprises a float chamber 1 containing electrical equipment for transmitting and receiving radio signals. The float consists of a cylindrical member 2 closed top and bottom by a hemispherical cap 4, 3 so as to form a robust pressure vessel. The internal equipment includes an antenna 5 located at the upper end of the float 1 within the upper hemispherical cap 4; the cap 4 acts as a radome.

Figure 5:
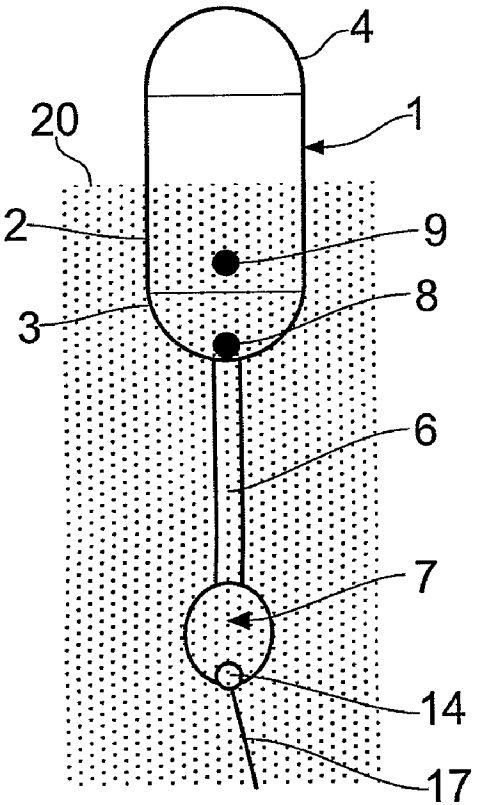
FIG. 5 is a schematic view of the buoy of FIG. 1 showing the centre of buoyancy, the centre of gravity and the tow point.

A rod 6 is connected to the lower hemispherical cap 3 and projects downwardly from it coaxially with the float 2 and carries a mass 7 at its lower end. The purpose of the mass 7 is to lower the centre of gravity of the buoy so that it is below the centre of buoyancy and thereby increases the surface stability of the float. This arrangement is illustrated schematically in FIG. 5, which shows the centre of gravity 8 and the centre of buoyancy 9. The magnitude of the mass is selected in relation to the mass of the other components of the buoy, but the overall mass is kept as low as possible to provide sufficient freeboard (i.e. height of floating buoy above steady-state water line), and to allow adequate heave performance. If the distance between the centre of gravity and centre of buoyancy 9 is too great, the buoy will sink in waves and the wash-over will impair radio performance. A reduced distance between centres 8, 9 will increase yaw and roll, but this also increases vertical drag in the water and therefore resists sinking to give improved heave performance.

The mass 7 itself comprises an electrical induction core 10 which forms part of a charging circuit within the buoy. The lower end 11 of the buoy is cone shaped and is adapted to dock with a cup shaped receiver of a docking system in an underwater towing vessel (not shown). When the buoy docks with the docking system, a magnetic inductive coupling is created through which a battery 12 within the buoy can be charged. The provision of an inductive charger in this manner, avoids the need to provide a power supply conductor within the tether, thereby reducing the tether diameter and associated drag.

A tapered fairing 13 is provided around the rod 6 so as to provide a continuous smooth external surface extending from the float 1 to the docking cone 11 at the lower end. The fairing 13 is open to ingress of sea water and therefore fills with sea water in operation. The enclosed sea water increases the mass moments of inertia of the buoy, which further helps to improve surface stability.

A tow point 14 is provided at the lower end of the buoy for connection of a tether 17.

Figure 3:
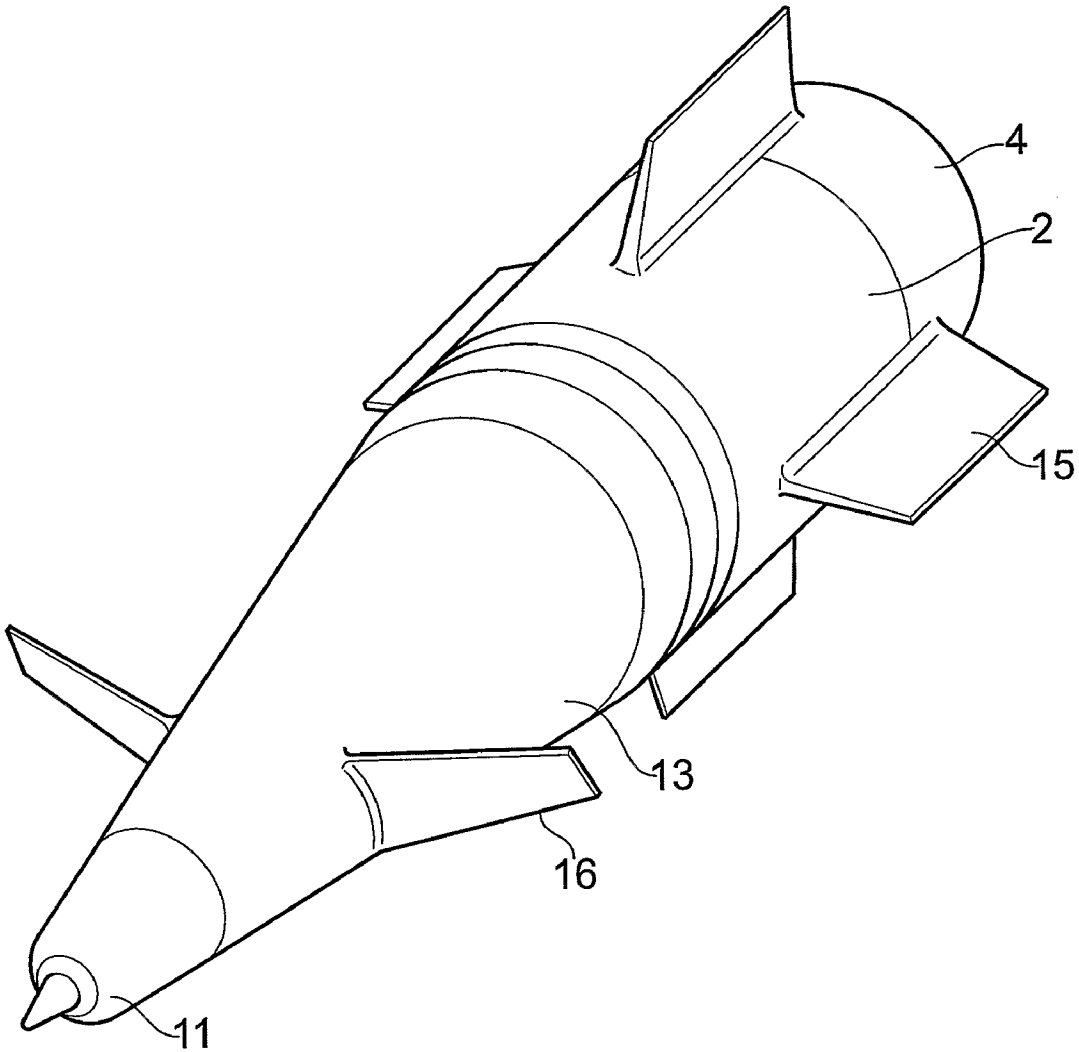
FIG. 3 is an external perspective view of the buoy of FIG. 1.
Figure 4:
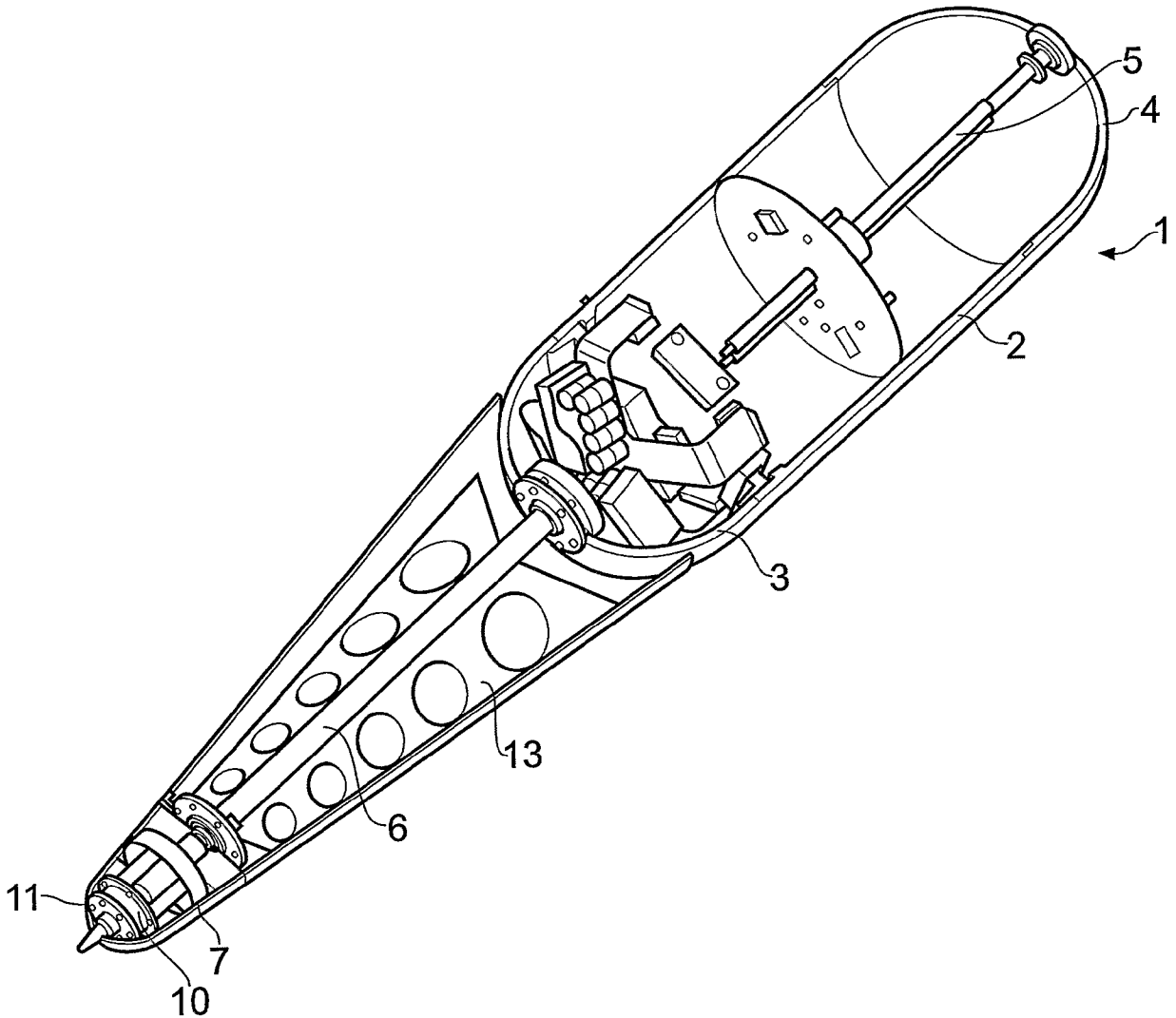
FIG. 4 is a cut away view of the buoy of FIG. 1 showing the major internal components.

The buoy also incorporates fins on its outer surface which serve to control the depth of the buoy when it is towed through the water to be recovered by the underwater towing vessel. The fins, as shown in FIG. 3 comprise four equi-angularly spaced fins 15 on the cylinder 2 which run parallel to the cylinder axis. The fins are not connected to the radome 4 and terminate sufficiently short of the radome to avoid impairing the RF performance of the buoy. The fins 15 serve to align the buoy generally along the line of the tether when the buoy is being towed through the water. The fins 15 resist rotation, and those fins aligned horizontally create a hydrodynamic downward force on the buoy.

In order to improve roll stability of the buoy when towed, the lower one of the fins 15 may be enlarged to act as a rudder, and the centre of gravity 8 may be offset downwards from the centre line towards the lower fin. Also, to increase stability, the sideways projecting fins 15 may be inclined downwards slightly towards their tips.

An additional pair of fins 16 is fitted to the fairing 13 towards the lower end of the buoy. Each of these fins 16 is set at an angle relative to the radial plane of the buoy so as to generate a hydrodynamic lifting force as the buoy is towed through the water. The two fins 16 are arranged as mirror images of one another on opposite sides of the fairing 13, and each is aligned with a respective fin 15. There is a further hydrodynamic action in that the fins 16 create vortices in the water, which enhance the downward force of the fins 15 downstream of the fins 16.

Figure 6:
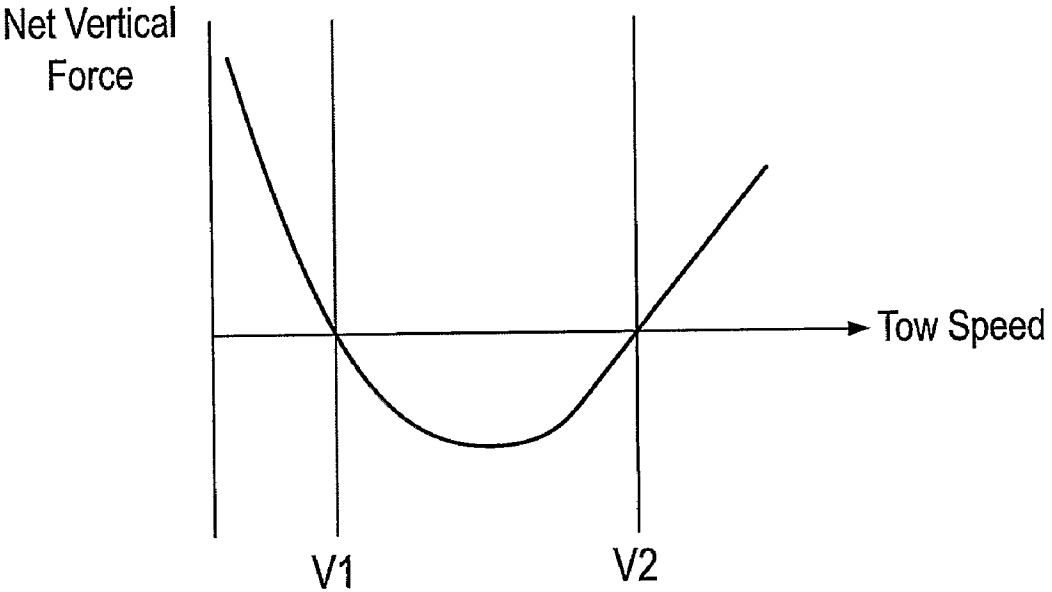
FIG. 6 is a graph of tow speed against vertical force for a buoy according to FIG. 1.

The effect of towing the buoy in the water is illustrated in FIG. 6, which shows the net vertical force experienced by the buoy against the tow speed. This shows that the buoy has two critical tow speeds V1, V2 at which the vertical force resulting from the buoyancy of the buoy, the tension in the tether and the hydrodynamic forces balance one another. Between these critical tow speeds, there is a net vertical downward force acting on the buoy which causes it to dive. The buoyancy remains constant but the hydrodynamic forces change with increasing speed as the buoy assumes a more horizontal position. Either side of these critical tow speeds V1, V2, the buoy experiences a net vertical upward force which will cause it to rise in the water. It will be readily appreciated from the characteristic in FIG. 6, that the depth of the buoy in the water can be controlled by regulating the tow speed. Therefore, the winding speed of a winch in an underwater vehicle towing the buoy is controlled so that the tow speed, after taking account of the speed of the towing vessel, is maintained at or near the critical tow speeds V1, V2. The actual control law used to regulate tow speed may vary depending upon the required path of recovery of the buoy. The buoy can be made to dive quickly from a floating mode as shown in FIG. 1, by increasing the tow speed rapidly, and thereafter the buoy can be maintained within a range of depths by increasing or decreasing the tow speed about one of the critical tow speeds.

Preferably, the buoy incorporates a depth sensor and depth measurements are transmitted back to the towing vessel and used in that control process to regulate the depth of the buoy.

In a typical installation in which a winch recovers the buoy at a rate of 2 m/second and in which an underwater vehicle may operate at speeds between 0 to 4 m/second, the buoy through water speed varies from 2 to 6 m/second. The buoy is therefore designed so that it has a critical lower through water speed of 2 m/second, above which it dives; a critical upper through water speed of 6 m/second, below which it dives and above which it rises, and the buoy is recovered at or marginally above a speed of 6 m/second.

At the 6 m/second recovery speed, the lift of the second hydrodynamic surface in the form of the front fins is maximised under stalled flow conditioner, and when the recovery speed is reduced in the final stages of recovery, the front fins still generate lift under attached flow conditions to minimise the depth of the buoy below the tow point on the underwater vehicle. Typically, the tow point is 2 metres above the underwater vehicle structure and determines the extent to which the buoy can be allowed to dive at the final reduced recovery speed. Typically, the reduced recovery speed applies during recovery of the last 5 metres of the tether.

The invention claimed is:

1. A buoy provided with first and second fixed hydrodynamic surfaces, which when the buoy is towed through water by a tether, the first hydrodynamic surface generates a downward force that reduces with increased through-water speed, and the second hydrodynamic surface generates an upward force that increases with increased through-water speed, so that the buoy dives up to an upper critical through-water speed and rises beyond said upper critical through-water speed.

2. A buoy as claimed in claim 1 in which the downward force of the first hydrodynamic surface overcomes the buoyancy of the buoy at a lower critical through-water speed, above which the buoy dives.

3. A buoy as claimed in claim 1 in which the hydrodynamic surface comprises a first fin or fins mounted on an outer casing of the buoy.

4. A buoy as claimed in claim 3 in which the first fin or fins are spaced angularly about the casing and extend parallel to a center axis of the buoy which when towed is substantially aligned with a direction of towing.

5. A buoy as claimed in claim 3 in which the second hydrodynamic surface comprises a second fin or fins mounted on an outer casing arranged upstream of the first fin or fins in a direction of towing.

6. A buoy as claimed in claim 5 in which the second fin or fins generates vortices which increase the hydrodynamic force experienced by the first fin or fins.

7. A buoy as claimed in claim 5 in which the second fin or fins comprise a pair of fins arranged as mirror images of one another on radially opposite sides of the outer casing.

8. A buoy as claimed in claim 1 in which the second hydrodynamic surface is set at an angle of incidence such that it creates a stalled flow condition at said upper critical through-water speed.

9. A buoy as claimed in claim 1 in which the buoy floats at the surface in an upright mode, and is provided with a tow point at its lower end.

10. A buoy as claimed in claim 9 in which its center of gravity is located below its centre of buoyancy.

11. A buoy as claimed in claim 9 in which the buoy comprises a float chamber adapted to contain electrical equipment for transmitting or receiving radio signals, and an elongate member that extends downwardly from the float chamber coaxially therewith and carries a mass at its lower end.

12. A buoy as claimed in claim 11 in which a fairing is provided that surrounds the elongate member and forms a substantially continuous surface with the buoy to reduce drag when towed in water.

13. A buoy as claimed in claim 12 in which the fairing allows entry of water within.

14. A buoy as claimed in claim 11 in which the mass comprises an electrical induction core which forms part of a charging circuit within the buoy.

15. A buoy as claimed in claim 14 in which the lower end of the buoy is adapted to dock with a receiver of a docking system in a recovery vessel towing the buoy.

16. A method of controlling recovery of a buoy comprising:

winding in a tether wound in from an underwater winding point, the buoy being as claimed in claim 1; and controlling the tow speed of the buoy to control the depth of the buoy.

17. A method of controlling the depth of a buoy when towed through water, the method comprising:

providing a buoy having a first and second fixed hydrodynamic surfaces orientated such that when the buoy is towed the first hydrodynamic surface generates a downward force that reduces with increased through-water speed, and the second hydrodynamic surface generates an upward force that increases with increased through-water speed so that the buoy experiences a net vertical force that is dependent on tow speed and falls to zero at a predetermined tow speed;

towing the buoy; and controlling the tow speed with reference to said predetermined tow speed as to control the depth of the buoy.

18. A method as claimed in claim 17 in which the net vertical force falls to zero at each of two different tow speeds, and acts downwards between said tow speeds and upwards either side of said tow speeds, the method further comprising:

controlling the tow speed with reference to either of said predetermined tow speeds.

19. A method as claimed in claim 18 in which the hydrodynamic surfaces comprise a fin or fins mounted on an outer casing of the buoy and orientated to generate a vertical force.

20. A method of recovering a buoy from a deployed state at the surface of water comprising:

connecting the buoy by a tether to an underwater vessel; and winding in the tether from the vessel, the speed with which the buoy is towed through the water being controlled so as to control the depth of the buoy as claimed in claim 16.

* * * * *